US007252065B1

(12) United States Patent
Keeton

(10) Patent No.: US 7,252,065 B1
(45) Date of Patent: Aug. 7, 2007

(54) ENERGY STORING STARTING DEVICE

(75) Inventor: William B. Keeton, Texarkana, TX (US)

(73) Assignee: Husqvarna Outdoor Products Inc., Augusta, GA (US)

( * ) Notice: Subject to any disclaimer, the term of this patent is extended or adjusted under 35 U.S.C. 154(b) by 0 days.

(21) Appl. No.: 11/431,983

(22) Filed: May 11, 2006

(51) Int. Cl.
*F02N 3/02* (2006.01)
*F02N 5/02* (2006.01)

(52) U.S. Cl. ..... 123/185.14; 123/185.3

(58) Field of Classification Search ..... 123/185.14, 123/185.3
See application file for complete search history.

(56) References Cited

U.S. PATENT DOCUMENTS

| | | | | |
|---|---|---|---|---|
| 2,857,984 A | | 10/1958 | Skinner | |
| 3,782,355 A | * | 1/1974 | Hamman | 123/185.3 |
| 4,441,466 A | | 4/1984 | Tangorra | |
| 4,543,922 A | | 10/1985 | Fugazza et al. | |
| 5,163,392 A | * | 11/1992 | Morishima et al. | 123/179.25 |
| 5,537,966 A | | 7/1996 | Ohnishi | |
| 5,970,940 A | | 10/1999 | Penton | |
| 6,325,036 B1 | | 12/2001 | Gracyalny et al. | |
| 6,508,220 B1 | * | 1/2003 | Akaike et al. | 123/185.14 |
| 6,679,217 B2 | * | 1/2004 | Nieda et al. | 123/185.14 |
| 6,739,303 B2 | * | 5/2004 | Harada et al. | 123/185.14 |
| 6,782,863 B2 | * | 8/2004 | Leasure et al. | 123/185.3 |
| 6,827,055 B2 | * | 12/2004 | Tsunoda et al. | 123/185.14 |
| 2004/0016311 A1 | * | 1/2004 | Hashiba | 74/8 |
| 2004/0168668 A1 | * | 9/2004 | Tsunoda et al. | 123/185.14 |
| 2005/0051127 A1 | | 3/2005 | Adam et al. | |

* cited by examiner

*Primary Examiner*—Carl S. Miller
*Assistant Examiner*—Arnold Castro
(74) *Attorney, Agent, or Firm*—Pearne & Gordon LLP

(57) ABSTRACT

An energy-storing starting device for an internal combustion engine includes a starter pulley and a starter spring. A spring housing at least partially houses the starter spring. A toothed housing includes a plurality of ratchet teeth. A pawl member is adapted to provide a locking engagement with at least one of the ratchet teeth of the toothed housing to thereby prevent rotation of the toothed housing in an engine starting direction. An actuator is adapted to disengage the pawl member from the toothed housing to thereby permit the toothed housing to rotate. In one example, the starting device includes engagement structure adapted to bias a portion of the pawl towards at least one of the ratchet teeth of the toothed housing automatically when the starter pulley is rotated. In addition or alternatively, the toothed housing includes an interior area that at least partially receives the spring housing.

20 Claims, 5 Drawing Sheets

ENERGY STORING STARTING DEVICE

FIELD OF THE INVENTION

The present invention relates generally to a recoil starting device for starting an internal combustion engine, and in particular to an energy-storing starting device for starting an internal combustion engine that reduces pulling forces required to start the engine.

BACKGROUND OF THE INVENTION

Conventionally, a recoil starter can be used to manually start an internal combustion engine, such as, for example, a small two-stroke engine. A rope pulley can be rotated by pulling an attached recoil rope that is wound onto the rope pulley, thereby transmitting a rotational force to a crankshaft of the internal combustion engine by way of a ratchet and/or clutch mechanism between the pulley and a flywheel and crankshaft. Rotation of the crankshaft drives a piston and can help to provide fuel for ignition. Rotation of the flywheel can also cause a magneto to power a spark plug, creating a spark for ignition of the engine fuel.

In operating such a starter mechanism, abrupt changes in the engine torque due to the compression of an air/fuel mixture by the piston and the cylinder within the engine can result in an uneven and jarring pulling force during starting, and possibly even some kickback forces. These forces can make starting the engine difficult for a user.

To reduce these fluctuations in pulling force, starter mechanisms can be provided with a buffering component, such as a spring. In such a solution, rotational energy stored within the buffering spring component can be used to assist in transmitting a rotational force to the engine crankshaft during periods of higher required torque, thereby dampening the pulling force required by the operator and smoothing the starting operation for the user. However, some fluctuations in the pulling force may still be present. Thus, there is a continuing need for an improved starting device for starting an internal combustion engine.

BRIEF SUMMARY OF THE INVENTION

The following presents a simplified summary of the invention in order to provide a basic understanding of some aspects of the invention. This summary is not an extensive overview of the invention. It is intended to identify neither key nor critical elements of the invention nor delineate the scope of the invention. Its sole purpose is to present some concepts of the invention in a simplified form as a prelude to the more detailed description that is presented later.

In accordance with an aspect of the present invention, an energy-storing starting device for an internal combustion engine having a crankshaft is provided, including a starter pulley with an engagement structure and a starter spring adapted to accumulate energy to rotate the crankshaft in an engine starting direction. A spring housing is operatively connected to the starter pulley and at least partially houses the starter spring. A portion of the starter spring is attached to the spring housing. A toothed housing includes a plurality of ratchet teeth. A portion of the starter spring is attached to the toothed housing. A pawl member is adapted to provide a locking engagement with at least one of the ratchet teeth of the toothed housing to thereby prevent rotation of the toothed housing in an engine starting direction. An actuator is adapted to disengage the pawl member from the toothed housing to thereby permit the toothed housing to rotate in an engine starting direction. The engagement structure is adapted to bias a portion of the pawl towards at least one of the ratchet teeth of the toothed housing automatically when the starter pulley is rotated.

In accordance with another aspect of the present invention, an energy-storing starting device for an internal combustion engine having a crankshaft is provided, including a starter pulley and a starter spring adapted to accumulate energy to rotate the crankshaft in an engine starting direction. A spring housing is operatively connected to the starter pulley and at least partially houses the starter spring. A portion of the starter spring is attached to the spring housing. A toothed housing includes a plurality of ratchet teeth and an interior area that at least partially receives the spring housing. A portion of the starter spring is attached to the toothed housing. A pawl member is adapted to provide a locking engagement with at least one of the ratchet teeth of the toothed housing to thereby prevent rotation of the toothed housing in an engine starting direction. An actuator is adapted to disengage the pawl member from the toothed housing to thereby permit the toothed housing to rotate in an engine starting direction.

BRIEF DESCRIPTION OF THE DRAWINGS

The foregoing and other features and advantages of the present invention will become apparent to those skilled in the art to which the present invention relates upon reading the following description with reference to the accompanying drawings, in which.

DESCRIPTION OF AN EXAMPLE EMBODIMENT

Figure 1:
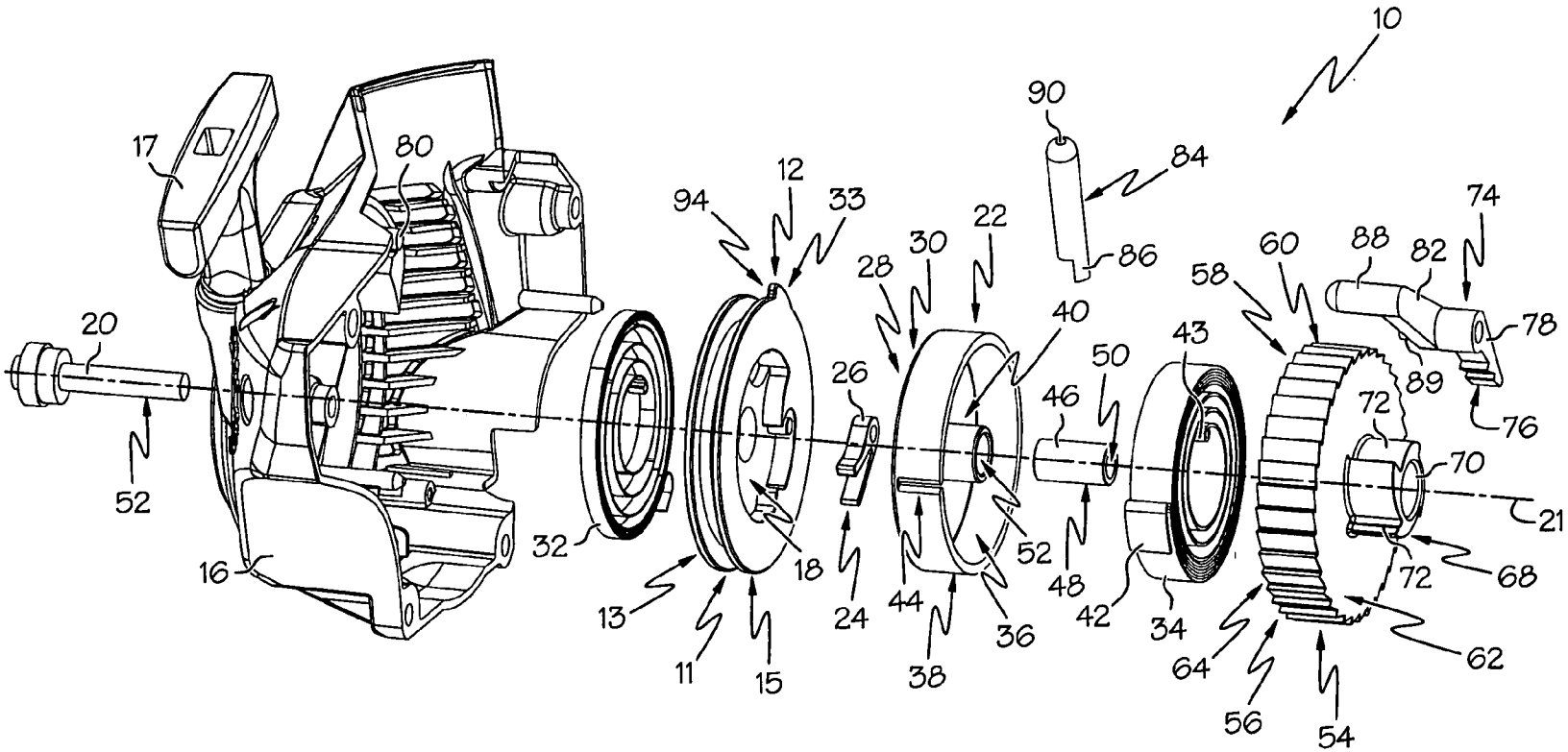
FIG. 1 is a perspective, exploded view of an example starting device in accordance with an aspect of the present invention.

An example embodiment of a starting device that incorporates aspects of the present invention is shown in the drawings. It is to be appreciated that the shown example is not intended to be a limitation on the present invention. For example, one or more aspects of the present invention can be utilized in other embodiments and even other types of starting devices.

Turning to the shown example of FIG. 1, an energy-storing starting device 10 for an internal combustion engine (not shown) having a crankshaft (not shown) is provided. The starting device 10 can be of the recoil starting type used to aid a manually started engine, such as a two-stroke engine, for example, which is typically adapted to be disposed in a gas-powered tool, such as a chain saw, line trimmer, blower/vac, or the like.

Figure 3:
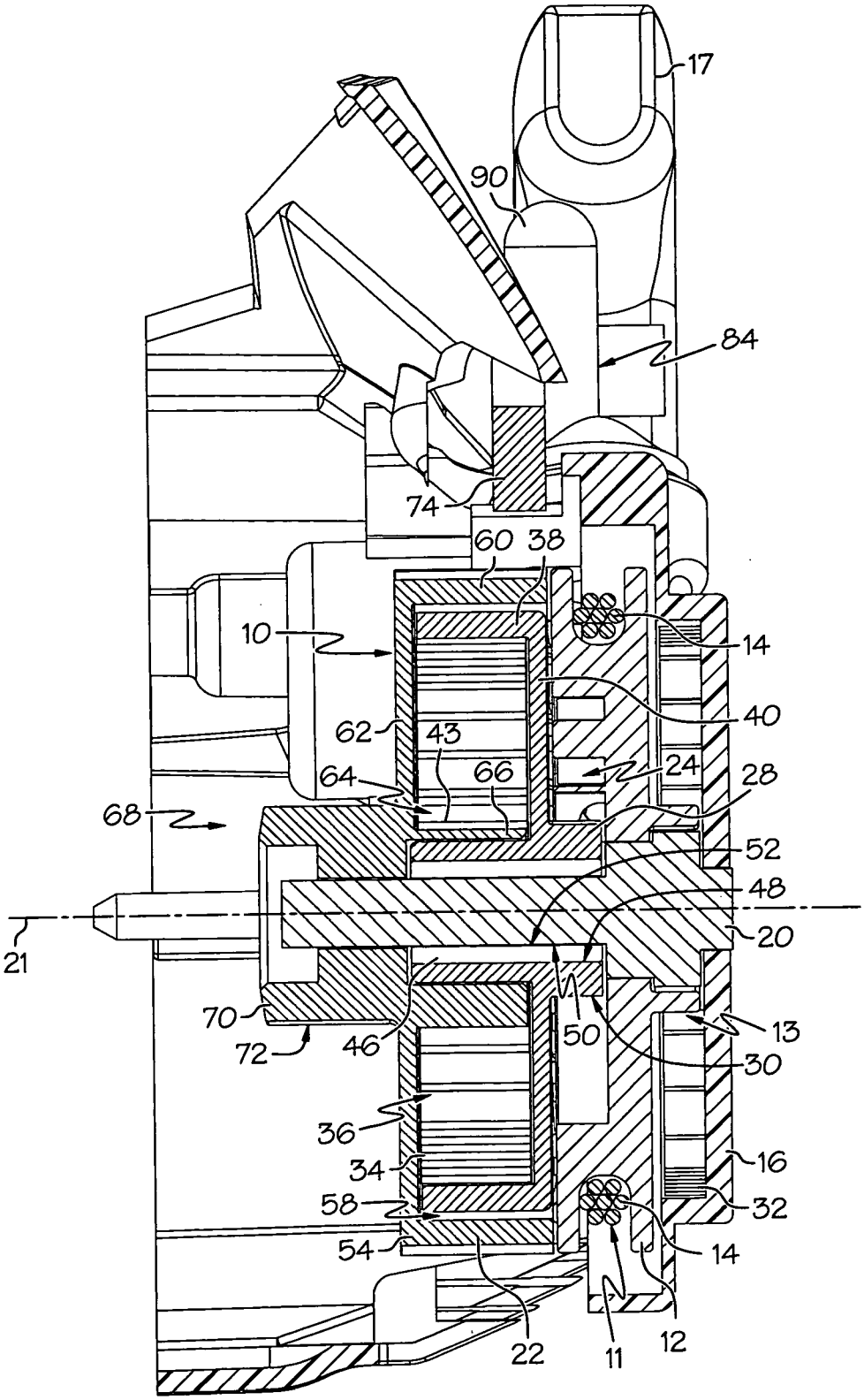
FIG. 3 is a sectional view of the starting device along line 3-3 of FIG. 2.

The starting device 10 can include a starter pulley 12 having a collar portion 11 for receiving a recoil rope 14 (see FIG. 3). For example, the collar portion 11 can include a groove adapted to retain a length of recoil rope 14 wound about the starter pulley 12. A handle 17 can be attached to one end of the recoil rope 14 to enable a user to pull the rope 14 to rotate the starter pulley 12.

Figure 2:
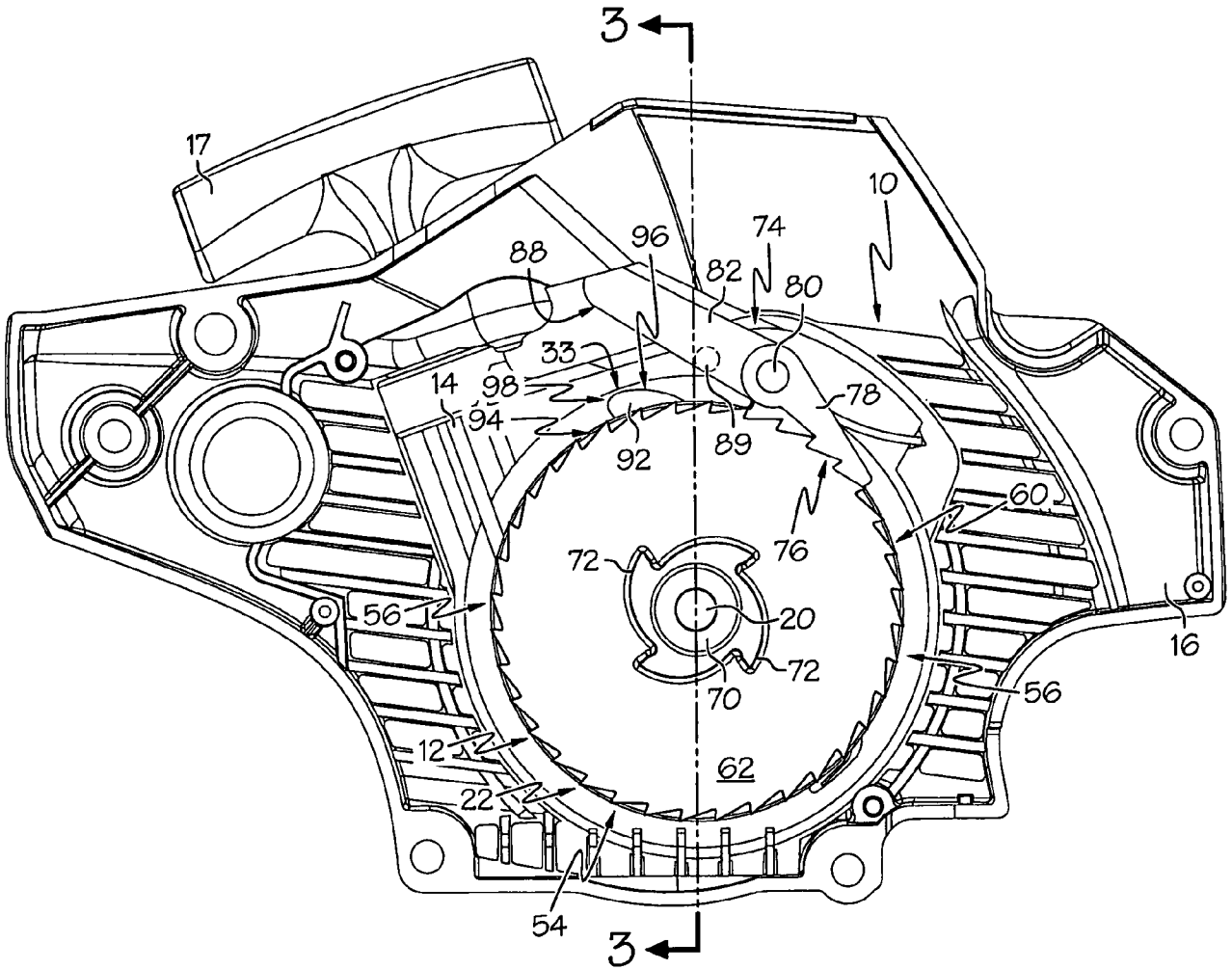
FIG. 2 is a front view of the starting device mounted within an example engine housing.

A first end 13 of the starter pulley 12 can include structure (not shown) to facilitate alignment with an engine housing 16 (see FIG. 2). For example, as shown in FIG. 3, the first end 13 can be adapted to rotate about a starter stud 20 or similar shaft having a central axis 21. In addition or alternatively, the first end 13 can be adapted to rotate about a shaft (not shown) formed with the engine housing 16. Thus, the starter pulley 12 can include a rotational axis that is coaxial to the central axis 21.

A second end 15 of the starter pulley 12 can include structure 18 to operatively couple the starter pulley 12 to other elements of the starting device 10, such as a spring housing 22. For example, the starter pulley 12 can be operatively coupled to the spring housing 22 (or other element) through a centrifugal clutch assembly 24. In this example, the starter pulley 12 can include at least one starter dog 26 pivotably attached thereto that is adapted to selectively engage a hub 28 of the spring housing 22 that includes a plurality of cam teeth 30.

The starter pulley 12 can also include additional structure. For example, the starter pulley 12 can include a recoil spring 32 adapted to recoil the starter pulley 12 after it has been rotated by the recoil rope 14. Thus, one portion of the recoil spring 32, such as an end, can be attached to the starter pulley 12 and another portion, such as the other end, can be attached to the engine housing 16. As shown, the recoil spring 32 can include a spiral spring, though any resilient element can be used. In addition or alternatively, the starter pulley 12 can include an engagement structure 33, as will be discussed more fully herein.

Turning briefly to FIG. 2, the engine housing 16 can include various geometries to house various engines (not shown) and the starting device 10. As shown, the starting device 10 can be disposed within an interior portion of the engine housing 16, though some or all of it can be disposed outside of the engine housing 16. Further, the engine housing 16 can include a substantially rigid material, such as plastic, metal, or the like. It is to be appreciated that the engine housing 16 can include various additional elements, such as air vents and/or holes for fasteners or engine components.

Returning to FIG. 1, the starting device 10 can also include a starter spring 34 adapted to accumulate energy to rotate the crankshaft (not shown) in an engine starting direction. As shown, the starter spring 34 can include a spiral spring, though it could also include other types of resilient elements, such as a helical or coil spring, or the like. The starter spring 34 can be adapted to accumulate enough energy therein to overcome the rotational resistance of the internal combustion engine, such as might be provided, for example, by the rotational inertia of the various engine elements and the compression stroke of the piston (not shown).

The starting device 10 can also include a spring housing 22 operatively connected to the starter pulley 12. As discussed above, the spring housing 22 can be operatively connected to the starter pulley 12 through a centrifugal clutch assembly 24. The spring housing 22 can also include an interior area 36 that at least partially houses the starter spring 34. As shown, for example, an annular periphery 38 and a base wall 40 of the spring housing 22 can bound the interior area 36. Further still, a portion of the starter spring 34 can be attached to the spring housing 22. As shown, one end 42 of the starter spring 34 can be received by complementary structure 44 of the spring housing 22. For example, the spring housing 22 can include a groove or the like that is adapted to retain the one end 42 of the starter spring 34. It is to be appreciated that the complementary structure 44 can be disposed in various locations on the spring housing 22, and can even be adapted to retain an alternate end 43 (i.e., the opposite end) of the starter spring 34.

Further still, the starting device 10 can include a one-way bearing 46 that can be adapted to permit the spring housing 22 to rotate only in an engine starting direction. For example, the one-way bearing 46 can act as a one-way clutch that permits an outer race 48 of the bearing 46 to rotate in only a single direction relative to an inner race 50 of the bearing 46. As shown, the outer race 48 of the bearing 46 can be received by a hole 52 extending though the base wall 40 of the spring housing 22. The outer race 48 can be attached to the spring housing 22 in various manners, including an interference fit, adhesives, fasteners, welding, molding, or the like. Additionally, the inner race 50 of the bearing 46 can be attached to an outer surface 54 the starter stud 20 using one or more of the aforementioned methods. It is to be appreciated that, as discussed above, the engine housing 16 can include a shaft (not shown) formed therewith that is similar to the stud shaft 20. Accordingly, if, for example, the formed housing shaft includes a plastic material, a metal sleeve (not shown) can be adapted to fit over the formed housing shaft to provide a hard surface for attachment to the inner race 50 of the one-way bearing 46. It is also to be appreciated that the starting device 10 can also include various other types of one-way clutch devices to permit only one-way rotation of the spring cup 22.

Thus, the one-way bearing 46 can permit the spring housing 22 to rotate in only a single direction relative to the starter stud 20. Thus, when a user pulls on the recoil rope 16, the starter pulley 12 is rotated in an engine starting direction about a rotational axis that is coaxial to the central axis 21 of the starter stud 20. The rotational force can be transmitted through the centrifugal clutch 24 to cause the spring housing 22 to also rotate in the same direction about a similar, coaxial rotational axis. However, when the recoil spring 32 subsequently causes the starter pulley 12 to recoil in the opposite direction (i.e., a non-engine-starting direction), the one-way bearing 46 can inhibit the spring housing 22 from rotating in the non-engine-starting direction. In one example, the one-way bearing 46 can substantially prevent the spring housing 22 from rotating in the non-engine-starting direction. In another example, the one-way bearing 46 can completely prevent the spring housing 22 from rotating in the non-engine-starting direction.

Keeping with the example shown in FIG. 1, the starting device 10 can also include a toothed housing 54 including a plurality of ratchet teeth 56. The toothed housing 54 can also include an interior area 58 that at least partially receives the spring housing 22. As shown, for example, an annular periphery 60 and a base wall 62 of the toothed housing 54 can bound the interior area 58. In one example, the interior area 58 can at least partially receive the spring cup. In another example, as shown in FIG. 3, a substantial portion of the spring housing 22, including the starter spring 34 housed therein, can be received within the interior area 58 of the toothed housing 54. In yet another example, the spring housing 22 can be substantially completely received within the interior area 58 of the toothed housing 54, though, as shown, the hub 28 containing the centrifugal clutch assembly 24 may or may not be received by the toothed hub 54.

Further still, the toothed housing 54 can include a rotational axis that is coaxial to the central axis 21. Thus, as shown, when the starting device 10 is assembled, the starter stud 20 can extend through at least the starter pulley 12, spring cup 22, one-way bearing 46, starter spring 34, and toothed housing 54. In addition, as shown, the assembly can be retained together by a fastener, retainer clip, or the like (not shown) attached to one end of the starter stud, such as an e-ring or the like.

Returning to FIG. 1, the plurality of ratchet teeth 56 can be disposed in a pattern about the annular periphery 60 of the toothed hub 54. For example, as shown in FIGS. 1-2, the ratchet teeth 56 can be arranged in an array such that each individual tooth abuts an adjacent tooth, though the ratchet teeth 56 can also be arranged such that each tooth is spaced a distance from the next tooth. In addition or alternatively, one or more of the ratchet teeth 56 can be disposed on the base wall 62. Further, the ratchet teeth 56 can have various geometries. For example, as shown, the ratchet teeth 56 can have a cam shaped surface. Indeed, various numbers of ratchet teeth 56 having various geometries can be arranged in various configurations about the toothed hub 56.

Further still, a portion of the starter spring 34 can be attached to the toothed housing 54. As shown in FIG. 3, one end 43 of the starter spring 34 can be received by complementary structure 64 disposed on an internal hub 66 of the toothed housing 54. For example, the toothed housing 54 can include a groove or the like that is adapted to retain the one end 43 of the starter spring 34. It is to be appreciated that the complementary structure 64 can be disposed in various locations on the toothed housing 54, and can even be adapted to retain the opposite end 42 of the starter spring 34.

The toothed hub 54 can also include various other elements. For example, the toothed hub 54 can include structure 68 to operatively couple it to other elements of the starting device 10, such as a flywheel (not shown). For example, the toothed housing 54 can be operatively coupled to the flywheel (or other element) through a centrifugal clutch assembly. In this example, the toothed hub 54 can include a hub 70 that includes a plurality of cam teeth 72 adapted to selectively engage at least one starter dog (not shown) operatively attached to the flywheel.

Returning now to FIG. 1, the starting device 10 can also include a pawl member 74 adapted to provide a locking engagement with at least one of the ratchet teeth 56 of the toothed housing 54 to thereby prevent rotation of the toothed housing 54 in an engine starting direction. The pawl member 74 can include one or more pawl teeth 76 adapted to intermesh with the ratchet teeth 56 of the toothed housing. For example, as shown in FIG. 2, the pawl member 74 can include two pawl teeth 76 adapted to intermesh with the ratchet teeth 56.

Additionally, the pawl member 74 can include at least a first arm 78 that can be adapted to pivot relative to the toothed hub 56. For example, the first arm 78 can be configured to pivot about a post 80 attached to the engine housing 16. The post 80 can be attached to the engine housing 16 using various methods, and can even be formed with the engine housing 16. Thus, by pivoting the first arm 78 about the post 80, the pawl teeth 76 can selectively engage and disengage the ratchet teeth 56 of the toothed housing 54.

Further still, the pawl member 74 can include a second arm 82 attached to the first arm 80. For example, as shown, the second arm 82 can be formed with the first arm 78, though it can also be attached using various methods. The second arm 82 can be configured to provide the motive force for pivoting the pawl member 74 about the post 80. For example, the second arm 82 can be operatively connected to an actuator 84, as will be discussed more fully herein. The preceding description of the pawl member 74 is not intended to provide a limitation upon the present invention, and as such the pawl member 74 can be configured to move in various other manners to engage or disengage the pawl teeth 76 from the toothed housing 56. For example, the pawl member 74 can be adapted to reciprocate, translate, move along a linear or nonlinear path, and/or rotate.

Figure 4B:
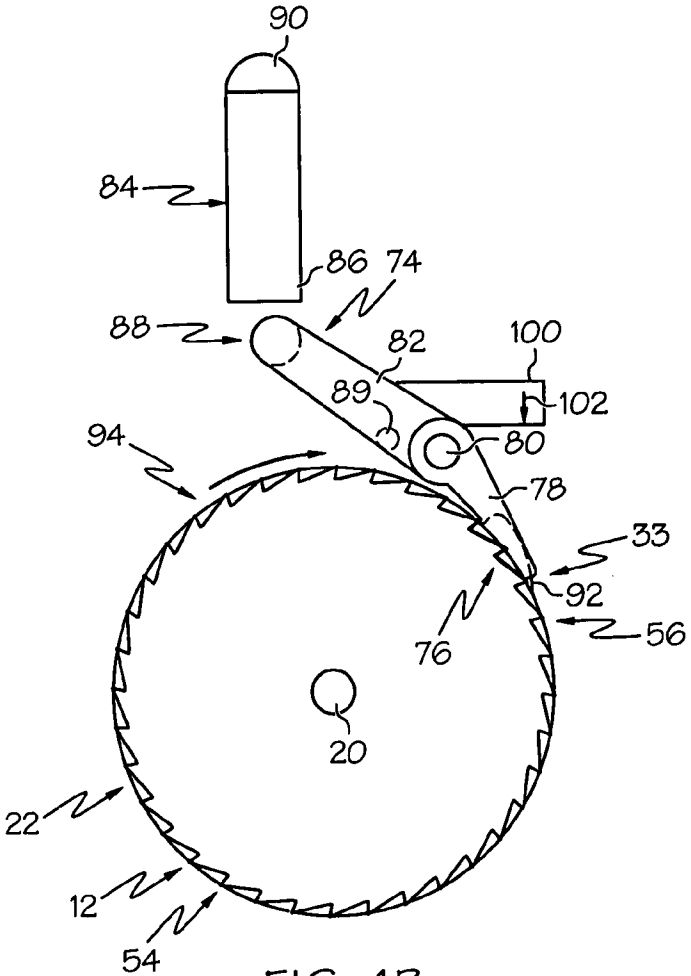
FIG. 4B is similar to FIG. 4A, but shows the pawl in locking engagement with the toothed housing.

As stated above, the starting device 10 can include an actuator 84 adapted to disengage the pawl member 74 from the toothed housing 54 to thereby permit the toothed housing 54 to rotate in an engine starting direction. For example, the actuator 84 can include a projection 86 that is adapted to engage a portion of the pawl member 74, such as the second arm 82. As shown in FIG. 1, the second arm 82 can include an extension 88 configured to engage the projection 86. As such, the actuator 84 can be adapted to selectively pivot the pawl member 74 about the post 80 to thereby disengage it from the toothed housing 54. For example, as shown in FIG. 4C, when the actuator 84 is moved vertically downwards, the projection 86 can engage the extension 88 to thereby pivot the first arm 78 of the pawl member 74 in lever action about the post 80. Accordingly, the pawl teeth 76 can pivot away from the ratchet teeth 56 of the toothed housing 54 to thereby disengage the pawl member 74 from the toothed housing 54.

It is to be appreciated that the actuator 84 can include various mechanisms. For example, as shown in FIG. 1, the actuator 84 can include a button-style mechanism that includes a button portion 90 adapted to be pressed by a hand of a user (not shown). Thus, as shown in FIG. 2 for example, the button portion 90 can extend a distance away from the engine housing 16 such that a user can easily access it when it is desired to start the internal combustion engine (not shown). In another example, the actuator 84 can comprise the extension 88. In this example, the extension 88 can extend a distance away from the engine housing 16 such that a user can easily access it to pivot the pawl member 74 about the post 80. In yet another example, the actuator 84 can include a pivotable lever arm (not shown) adapted to engage a portion of the pawl member 74, such as the extension 88, to pivot it about the post 80. In still yet another example, the actuator 84 can include a rotatable knob (not shown) that can be attached to the aforementioned post 80. In this example, the first arm 78 of the pawl member 74 can be fixedly attached to the post 80, and thus operatively connected to the knob, such that a user can rotate the knob to thereby cause the pawl member 74 to pivot. It is to be appreciated that the actuator 84 can include various other mechanisms adapted to pivot the pawl member 74.

In addition or alternatively, the actuator 84 can be resiliently biased away from the pawl member 74. For example, as shown, if the actuator 84 includes a button-style mechanism, the projection 86 can be resiliently biased away (e.g., upwards, as shown) from the second arm 82 of the pawl member 74. Accordingly, as shown in FIG. 3, the button portion 90 can be correspondingly resiliently biased away from the engine housing 16. The starting device 10 can include various resilient structures adapted to resiliently bias the actuator 84 away from the pawl member 74. For example, the starting device 10 can include various types of springs (not shown) operatively connected to the actuator 84. In addition or alternatively, various types of springs (not shown) can be operatively connected to the pawl member 74. Thus, even though the projection 86 can be located adjacent to, and can even abut, the second arm 82 of the pawl member 74, the actuator 84 can be resiliently biased away from the pawl member 74 such that it applies little, if any, force upon the second arm 82. In one example, if a user wishes to actuate the actuator 84, the user must first overcome the resilient biasing force before the projection 86 can engage the second arm 82.

As discussed above, the starter pulley 12 can include an engagement structure 33. The engagement structure 33 can be adapted to bias a portion of the pawl member 74 towards at least one of the ratchet teeth 56 of the toothed housing 54 automatically when the starter pulley 12 is rotated. In the shown example of FIG. 2, the engagement structure 33 can comprise a member 92 protruding from a periphery 94 of the starter pulley 12. As shown, the member 92 can protrude radially from the periphery 94 of the second end 15 of the starter pulley 12, though it is to be appreciated that the member 92 can be disposed on the starter pulley 12 in various locations and can protrude therefrom in various directions, such as axially, tangentially, and/or at various angles. The starter pulley 12 can also include various numbers of engagement structures 33 disposed in various locations.

Further, the engagement structure 33 can comprise a cam surface 96. For example, the member 92 can include an edge 98 that extends away from the periphery 94 at varying distances along its length. As shown, member 92 can include a ramped geometry such that the edge 98 extends away from the periphery 94 at an increasing distance along its length. Thus, as the starter pulley 12 rotates, the engagement structure 33 can be adapted to engage a portion of the pawl member 74. For example, the member 92 can be adapted to engage a protrusion 89 disposed on the second arm 82 to cause the pawl member 74 to pivot about the post 80.

The starting device 10 can also include additional structure. For example, after the engagement structure 33 has caused the teeth 76 of the pawl member 74 to pivot towards the ratchet teeth 56, it can be beneficial to maintain the engagement therebetween to prevent rotation of the toothed housing 54 and to provide clearance between the pawl member 74 and the engagement member 33 as the starter pulley 12 continues to rotate. As shown in FIGS. 4A-4D, the starting device 10 can include a toggle mechanism 100 adapted to resiliently bias the pawl member 74 into locking engagement with at least one of the ratchet teeth 56 of the toothed housing 54 in response to interaction with the engagement structure 33. For example, the toggle mechanism 100 can include various types of toggle springs, such as an over-center spring or the like, though other resilient devices can also be used. For the sake of clarity, the toggle device 100 is shown schematically in the figures, and arrows 102, 104 are used to indicate example forces that can be applied by the toggle device 100 to the pawl member 74.

As discussed above, the engagement structure 33 can be adapted to engage the protrusion 89 of the second arm 82 to cause the pawl member 74 to pivot about the post 80. Thus, after the engagement structure 33 causes the pawl member 74 to pivot, the toggle mechanism 100 can be adapted to supply a force 102 to the first arm 76 to thereby resiliently bias the pawl member 74 into locking engagement with the ratchet teeth 56.

In addition, the toggle mechanism 100 can be adapted to resiliently bias the pawl member 74 away from the at least one of the ratchet teeth 56 of the toothed housing 54 in response to interaction with the actuator 84. Thus, after the actuator 84 causes the pawl member 74 to pivot, the toggle mechanism 100 can be adapted to supply a force 104 to the second arm 82 to thereby resiliently bias the pawl member 74 away from the ratchet teeth 56. It is to be appreciated that the toggle mechanism 100 can be adapted to release the force 104 on the second arm 82 when it applies the force 102 to the first arm 78, and correspondingly release the force 102 to the first arm 78 when it applies the force 104 on the second arm 82. Further still, the starting device can include more than one toggle mechanism 100.

An example operation of the starting device 10, as shown in FIGS. 4A-4D, will now be described. To start the internal combustion engine (not shown), a user can grasp the handle 17 and pull it to rotate the starter pulley 12 via the recoil rope 14. When the starter pulley 12 is rotated, the starter dog 26 of the centrifugal clutch assembly 24 can engage at least one of the cam teeth 30 of the spring cup 22 to cause corresponding rotation of the spring cup 22 in an engine starting direction.

Figure 4A:
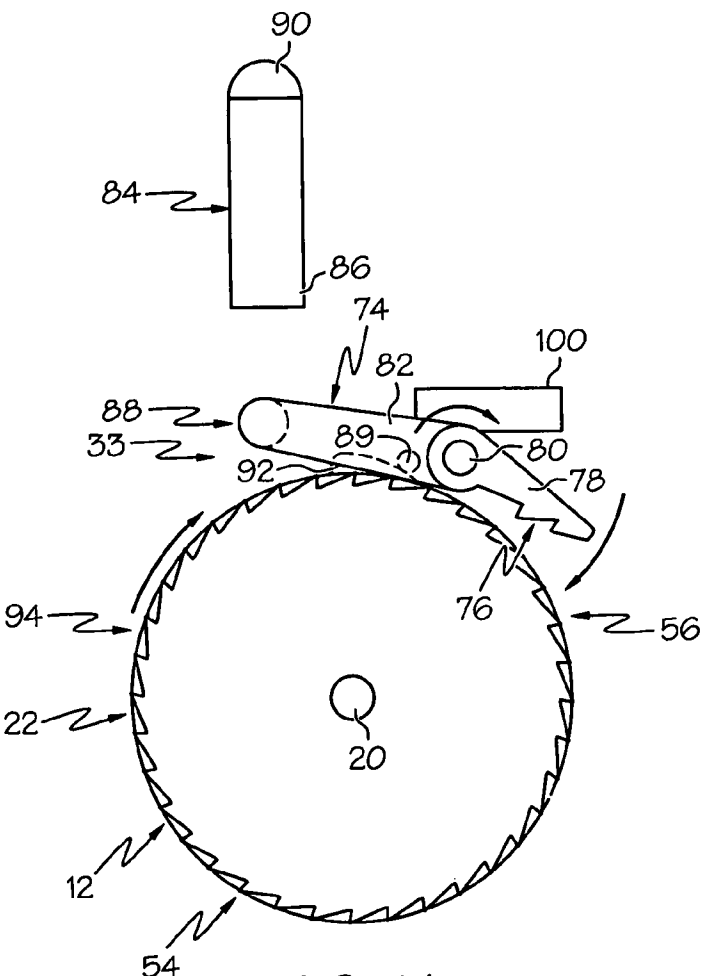
FIG. 4A is a detail view of the starting device, showing an example pawl biased towards an example toothed housing.

In the shown example of FIG. 4A, as the starter pulley 12 rotates, the engagement structure 33 will also rotate until it contacts the pawl member 74. For example, cam surface 96 of the member 92 can contact the protrusion 89 of the second arm 82. As the starter pulley 12 rotates, the cam surface 96 will drive the protrusion 89 to rotate the pawl member 74 about the post 80 to thereby bias the first arm 78 towards the ratchet teeth 56 of the toothed hub 54. Next, as shown in FIG. 4B, the toggle mechanism 100 can apply a force 102 to the first arm 78 to resiliently bias the pawl teeth 76 into interlocking engagement with the ratchet teeth 56. Also, as shown, the engagement structure 33 will continue to rotate with the starter pulley 12.

Thus, because the pawl member 74 prevents the toothed hub 54 from rotation, and because the starter spring 34 is attached to both the spring cup 22 and the toothed housing 54, rotation of the spring cup 22 in the engine starting direction can cause energy to be stored in the starter spring 34. Next, when the user releases the recoil rope 14, the recoil spring 32 can cause the starter pulley 12 to rotate in an opposite direction (i.e., a non-engine-starting direction) to thereby recoil the recoil rope 14. However, as discussed herein, the one-way bearing 46 can inhibit the spring cup 22 from rotating in the opposite direction. As such, the energy stored in the starter spring 34 will be maintained. Accordingly, as the starter pulley 12 and the spring cup 22 are further rotated, an increasing amount of energy will be stored in the starter spring 34.

Figure 4D:
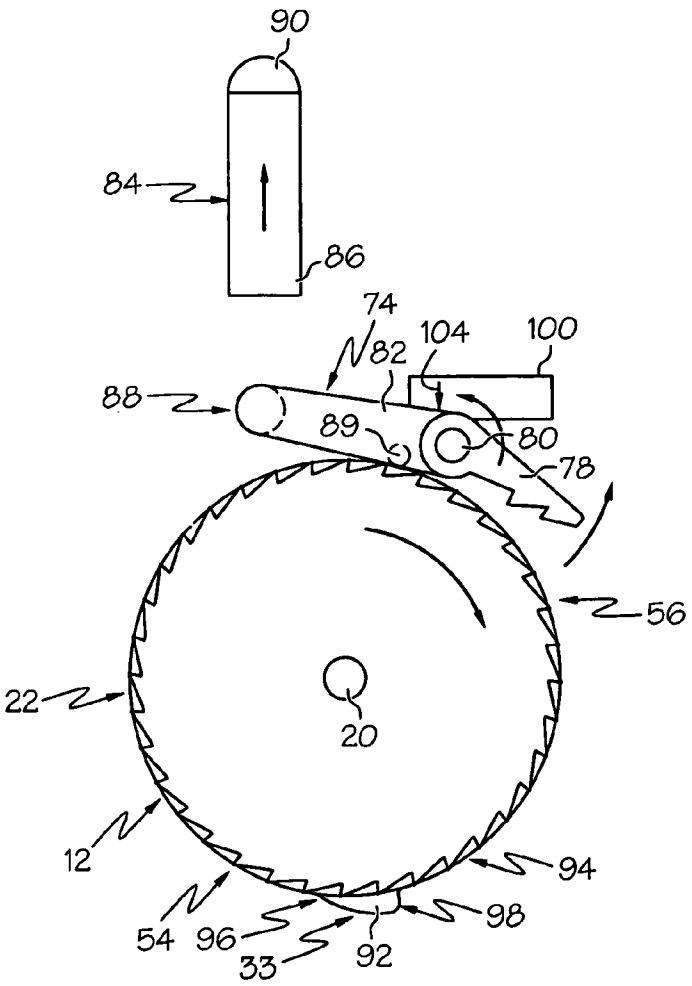
FIG. 4D is similar to FIG. 4C, but shows the pawl biased away from the toothed housing.
Figure 4C:
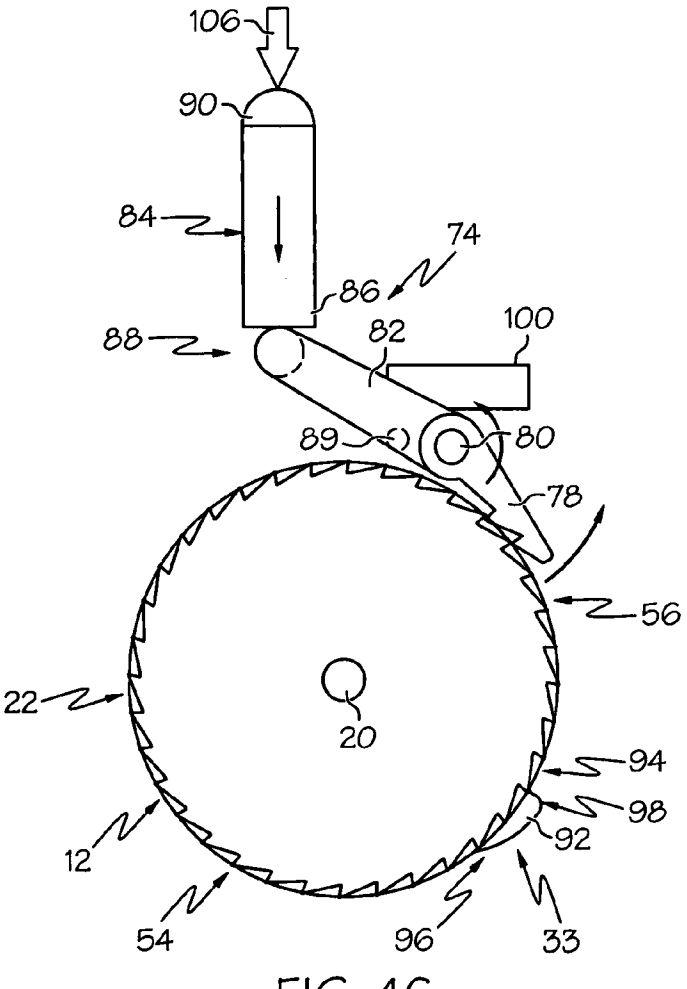
FIG. 4C is similar to FIG. 4A, but shows the pawl disengaged from the toothed housing.

Next, a user can actuate the actuator 84 when it is desired to start the internal combustion engine (not shown). For example, as shown in FIG. 4C, a user can apply a force 106 to the button portion 90 of the actuator 84 to thereby cause the projection 86 to engage the extension 88 of the second arm 82. Thus, the pawl member 74 can pivot about the post 80 to disengage the pawl teeth 76 from the ratchet teeth 56. Next, as shown in FIG. 4D, when the user ceases to apply the force 106 to the button portion 90, the actuator 84 can be resiliently biased away from the pawl member 74. Simultaneously, the toggle mechanism 100 can apply a force 104 to the second arm 82 to resiliently bias it away from the ratchet teeth 56.

In response, the stored energy in the starting spring 34 can be released to cause the toothed housing 54 to rotate in an engine starting direction. When the toothed housing 54 is rotated, the cam teeth 72 on the hub 70 can engage corresponding cam teeth (not shown) attached to additional engine structure, such as a flywheel (not shown) or the like, to cause the engine to rotate in an engine starting direction to thereby start the engine. It is to be appreciated that the toothed housing 54 can be operatively connected to the engine through various mechanisms, including various centrifugal clutches, and the like. In addition, if the engine fails to start, the engine starting process can be repeated until the engine has successfully started.

The starting device 10 and/or the internal combustion engine (not shown) can also include other steps or structure adapted to facilitate the starting process. For example, the flywheel, or other engine structure, can contain a plurality of magnets (not shown), which are operable to generate a magnetic field upon rotation of the flywheel. When the magnets spin around electric coils (not shown) of a magneto (not shown), an electric current is generated, which thereby passes to a spark plug (not shown) to ignite the air/fuel mixture to thereby cause the explosion that drives the piston and the crankshaft. It is to be appreciated that various other examples of engine structure and/or steps can also be used with the starting device 10.

The invention has been described with reference to various example embodiments. Obviously, modifications and alterations will occur to others upon a reading and understanding of this specification. It is intended to include all such modifications and alterations insofar as they come within the scope of the appended claims or the equivalents thereof.

What is claimed is:

1. An energy-storing starting device for an internal combustion engine having a crankshaft, the starting device including:

a starter pulley including an engagement structure;

a starter spring adapted to accumulate energy to rotate the crankshaft in an engine starting direction;

a spring housing operatively connected to the starter pulley and at least partially housing the starter spring, wherein a portion of the starter spring is attached to the spring housing;

a toothed housing including a plurality of ratchet teeth, wherein a portion of the starter spring is attached to the toothed housing;

a pawl member adapted to provide a locking engagement with at least one of the ratchet teeth of the toothed housing to thereby prevent rotation of the toothed housing in an engine starting direction; and an actuator adapted to disengage the pawl member from the toothed housing to thereby permit the toothed housing to rotate in an engine starting direction, wherein the engagement structure is adapted to bias a portion of the pawl towards at least one of the ratchet teeth of the toothed housing automatically when the starter pulley is rotated.

2. The starting device of claim 1, wherein the engagement structure comprises a member protruding from a periphery of the starter pulley.

3. The starting device of claim 1, wherein the engagement structure comprises a cam surface.

4. The starting device of claim 1, wherein the toothed housing further includes an interior area that at least partially receives the spring housing.

5. The starting device of claim 4, wherein a substantial portion of the spring housing is received within the interior area of the toothed housing.

6. The starting device of claim 1, wherein the actuator is adapted to selectively pivot the pawl member to disengage the pawl member from the toothed housing.

7. The starting device of claim 1, further comprising a toggle mechanism adapted to resiliently bias the pawl member into locking engagement with at least one of the ratchet teeth of the toothed housing in response to interaction with the engagement structure.

8. The starting device of claim 7, wherein the toggle mechanism is further adapted to resiliently bias the pawl member away from the at least one of the ratchet teeth of the toothed housing in response to interaction with the actuator.

9. The starting device of claim 1, further comprising a one way bearing adapted to permit the spring housing to rotate only in an engine starting direction.

10. The starting device of claim 1, wherein the actuator is resiliently biased away from the pawl member.

11. An energy-storing starting device for an internal combustion engine having a crankshaft, the starting device including:

a starter pulley;

a starter spring adapted to accumulate energy to rotate the crankshaft in an engine starting direction;

a spring housing operatively connected to the starter pulley and at least partially housing the starter spring, wherein a portion of the starter spring is attached to the spring housing;

a toothed housing including a plurality of ratchet teeth and an interior area at least partially receiving the spring housing, wherein a portion of the starter spring is attached to the toothed housing;

a pawl member adapted to provide a locking engagement with at least one of the ratchet teeth of the toothed housing to thereby prevent rotation of the toothed housing in an engine starting direction; and an actuator adapted to disengage the pawl member from the toothed housing to thereby permit the toothed housing to rotate in an engine starting direction.

12. The starting device of claim 11, wherein a substantial portion of the spring housing is received within the interior area of the toothed housing.

13. The starting device of claim 11, wherein the starter pulley further comprises an engagement structure that is adapted to bias a portion of the pawl towards at least one of the ratchet teeth of the toothed housing automatically when the starter pulley is rotated.

14. The starting device of claim 13, wherein the engagement structure comprises a member protruding from a periphery of the starter pulley.

15. The starting device of claim 13, wherein the engagement structure comprises a cam surface.

16. The starting device of claim 13, further comprising a toggle mechanism adapted to resiliently bias the pawl member into locking engagement with at least one of the ratchet teeth of the toothed housing in response to interaction with the engagement structure.

17. The starting device of claim 16, wherein the toggle mechanism is further adapted to resiliently bias the pawl member away from the at least one of the ratchet teeth of the toothed housing in response to interaction with the actuator.

18. The starting device of claim 11, wherein the actuator is adapted to selectively pivot the pawl member to disengage the pawl member from the toothed housing.

19. The starting device of claim 11, further comprising a one way bearing adapted to permit the spring housing to rotate only in an engine starting direction.

20. The starting device of claim 11, wherein the actuator is resiliently biased away from the pawl member.

* * * * *